US011148000B2

(12) United States Patent
Sauers et al.

(10) Patent No.: US 11,148,000 B2
(45) Date of Patent: Oct. 19, 2021

(54) EXERCISE DEVICE

(71) Applicant: Brandon Sauers, Center Valley, PA (US)

(72) Inventors: Brandon Sauers, Bethlehem, PA (US); Matthew Sommerfield, Allentown, PA (US)

(73) Assignee: Brandon Sauers, Bethlehem, PA (US)

( * ) Notice: Subject to any disclaimer, the term of this patent is extended or adjusted under 35 U.S.C. 154(b) by 0 days.

(21) Appl. No.: 16/429,356

(22) Filed: Jun. 3, 2019

(65) Prior Publication Data

US 2020/0086160 A1 Mar. 19, 2020

Related U.S. Application Data

(63) Continuation-in-part of application No. 15/842,367, filed on Dec. 14, 2017, now abandoned.

(60) Provisional application No. 62/435,012, filed on Dec. 15, 2016, provisional application No. 62/680,527, filed on Jun. 4, 2018.

(51) Int. Cl.

| | |
|---|---|
| ***A63B 21/06*** | (2006.01) |
| ***A63B 21/00*** | (2006.01) |
| ***A63B 15/00*** | (2006.01) |
| ***A63B 23/12*** | (2006.01) |
| *A63B 21/072* | (2006.01) |
| *A63B 43/02* | (2006.01) |

(52) U.S. Cl.

CPC ..... *A63B 21/0601* (2013.01); *A63B 15/00* (2013.01); *A63B 21/0004* (2013.01); *A63B 21/0608* (2013.01); *A63B 23/1209* (2013.01); *A63B 21/0603* (2013.01); *A63B 21/0728* (2013.01); *A63B 43/02* (2013.01)

(58) Field of Classification Search

CPC ..... A63B 21/0004; A63B 21/0601; A63B 21/0603; A63B 21/0608; A63B 21/072; A63B 21/0728; A63B 23/1263; A63B 23/1209; A63B 23/03525; A63B 15/00; A63B 43/02

See application file for complete search history.

(56) References Cited

U.S. PATENT DOCUMENTS

| | | | | |
|---|---|---|---|---|
| 2,396,408 | A | 3/1946 | Benecke | |
| 4,302,008 | A | 11/1981 | Lard | |
| 5,026,064 | A | 6/1991 | Novosel | |
| 6,132,345 | A | 10/2000 | Beierschmitt et al. | |
| 8,246,495 | B2 * | 8/2012 | James | A63B 69/0091 473/451 |
| 8,888,666 | B2 * | 11/2014 | Quader | A63B 21/4035 482/109 |
| 9,526,671 | B2 * | 12/2016 | Weck | A61H 23/006 |
| 9,586,073 | B2 * | 3/2017 | Walker | A63B 21/072 |
| 9,744,398 | B1 * | 8/2017 | Stoddard | A63B 69/0028 |
| 10,166,428 | B2 * | 1/2019 | Giafardino | A63B 15/00 |

(Continued)

*Primary Examiner* — Megan Anderson
(74) *Attorney, Agent, or Firm* — Patrick J Halloran

(57) ABSTRACT

The disclosure provides an exercise device comprising a weighted head and handle to simulate swinging a sledgehammer without causing the damage typically resulting from a sledgehammer having a solid head or hammer portion attached to a handle. Some embodiments provide quick release connectors between the weighted head and the handle. Methods for producing and using the weighted head and handle are also disclosed.

2 Claims, 10 Drawing Sheets

(56) References Cited

U.S. PATENT DOCUMENTS

| | | | | |
|---|---|---|---|---|
| 2002/0165070 | A1* | 11/2002 | Pullaro | A63B 15/00 482/109 |
| 2009/0069127 | A1 | 3/2009 | James | |
| 2010/0204020 | A1 | 8/2010 | Thomas et al. | |
| 2012/0149539 | A1* | 6/2012 | Quader | A63B 21/00072 482/109 |
| 2014/0051554 | A1 | 2/2014 | Walker | |
| 2014/0057763 | A1* | 2/2014 | Fritsch | A63B 21/169 482/109 |
| 2014/0309081 | A1 | 10/2014 | Gavigan | |
| 2015/0148202 | A1* | 5/2015 | Henry | A63B 21/08 482/109 |
| 2018/0036576 | A1* | 2/2018 | Richardson | A63B 21/4043 |
| 2019/0151700 | A1* | 5/2019 | D'Alesio | A63B 21/06 |

* cited by examiner

FIG. 1B
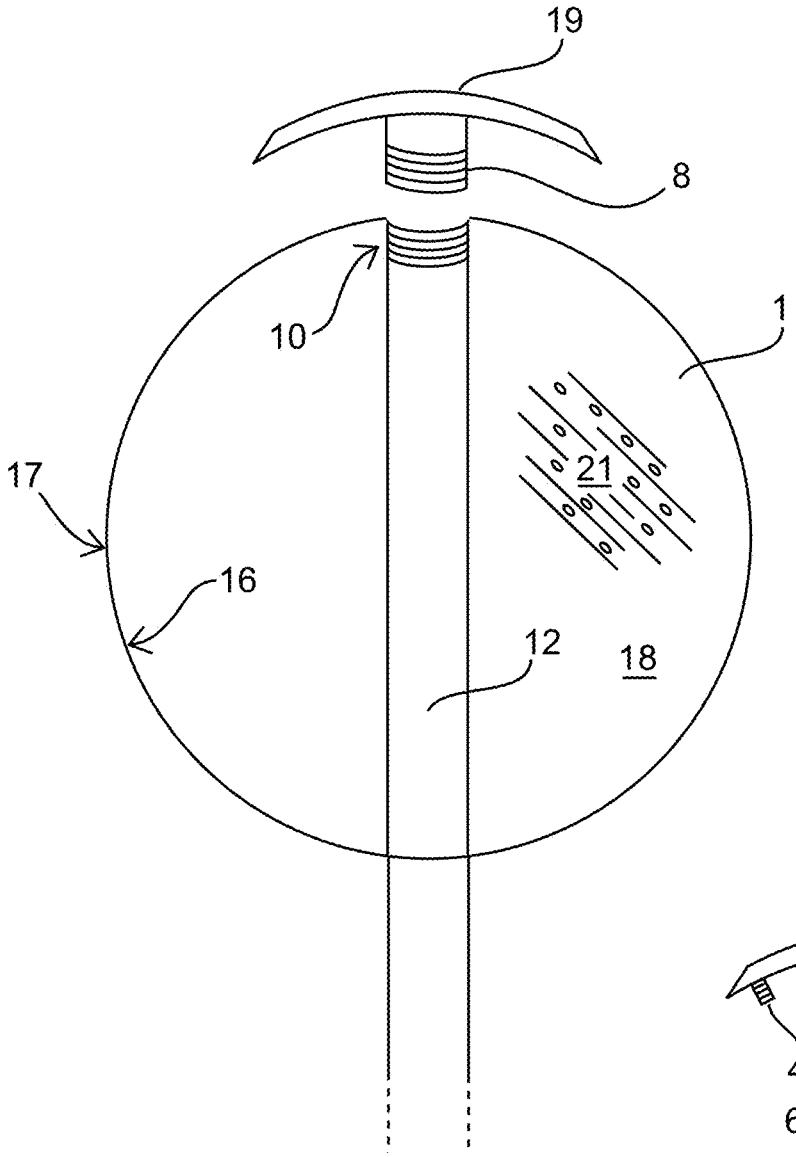
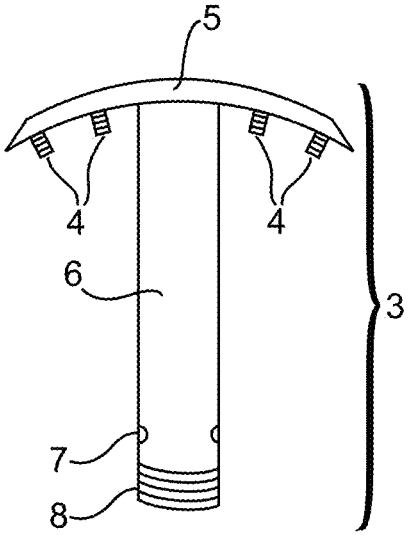
FIG. 1C

EXERCISE DEVICE

RELATED APPLICATIONS

This application is a continuation-in-part of U.S. Ser. No. 15/842,367 filed on Dec. 14, 2017, which claims priority to U.S. Ser. No. 62/435,012 filed on Dec. 15, 2016. This application also claims priority to U.S. Ser. No. 62/680,527 filed on Jun. 4, 2018.

FIELD OF THE DISCLOSURE

This disclosure relates to the field of exercise devices.

BACKGROUND OF THE DISCLOSURE

There is a need in the art for exercise devices that simulate swinging a sledgehammer without causing the damage typically resulting from sledgehammer having a solid (e.g., steel) head or hammer portion attached to a handle.

BRIEF DESCRIPTION OF THE DRAWINGS

FIG. 1. Exemplary design of exercise device. FIG. 1B. Second view of exemplary design of exercise device. FIG. 1C. Third view of exemplary design of exercise device.

FIG. 3.

FIG. 4.

SUMMARY OF THE DISCLOSURE

Figure 1A:
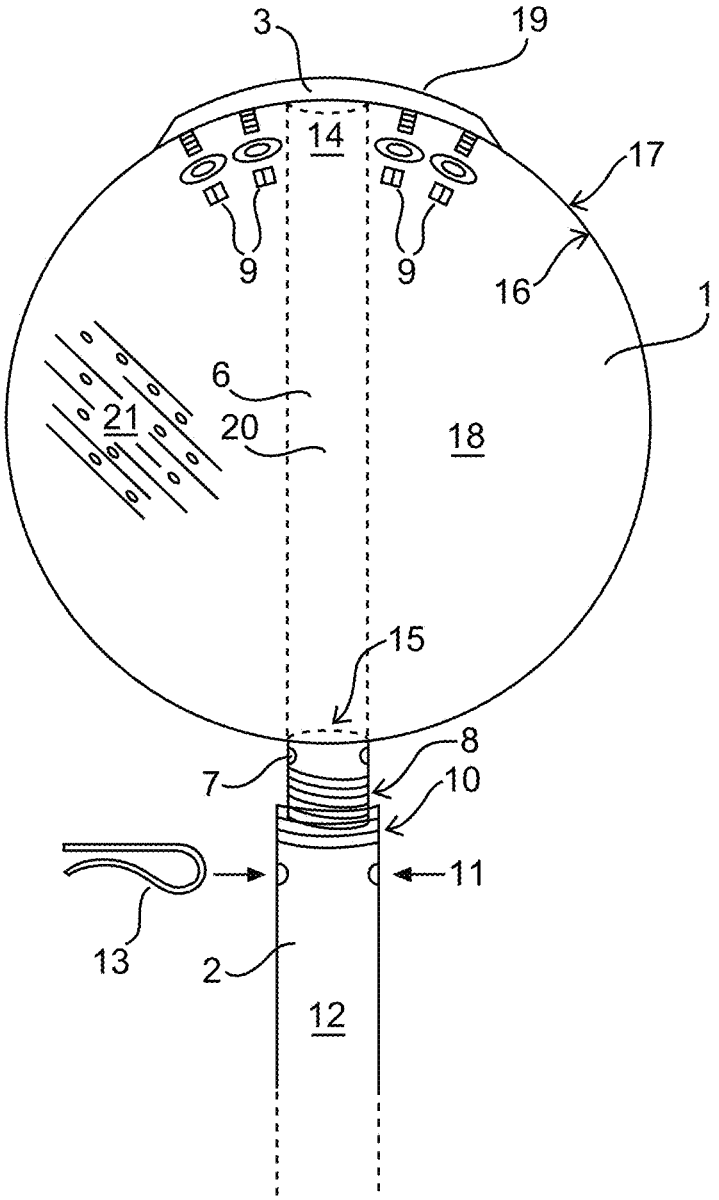
FIG. 1A. First view of exemplary design of exercise device.
Figure 2:
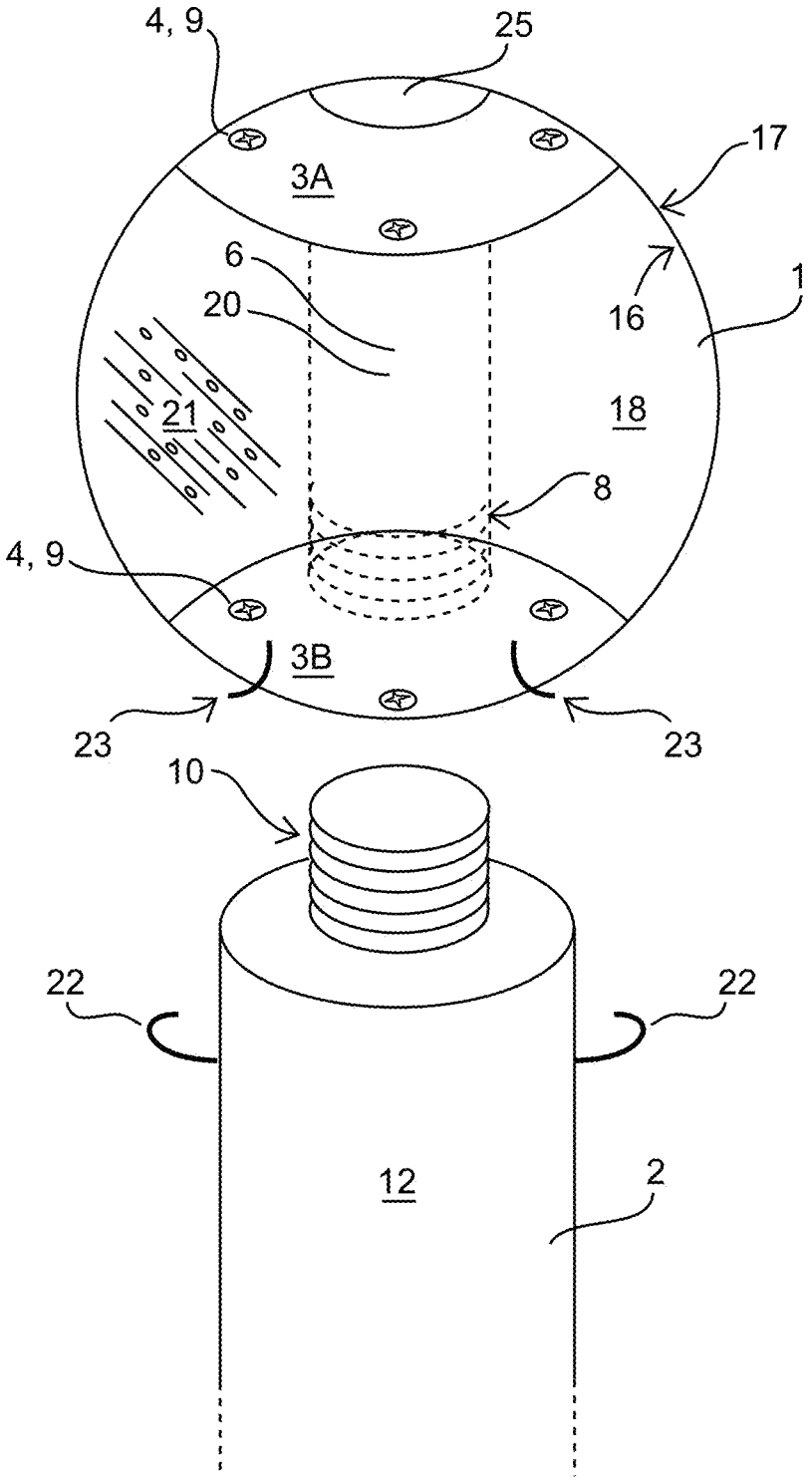
FIG. 2. Second exemplary design of exercise device.

This disclosure provides an exercise device comprising a weighted head and a handle, as well as methods for producing and using the same. In some embodiments, the exercise device may be essentially as shown in FIG. 1, FIG. 2, FIG. 3, and/or FIG. 4.

DETAILED DESCRIPTION OF THE INVENTION

This disclosure relates to exercise devices comprising a weighted head and handle. In one embodiment, the exercise device may be essentially as shown in FIG. 1, FIG. 2, FIG. 3, and/or FIG. 4. In some embodiments, the exercise device may comprise: a weighted head (1); a handle (2) (in some embodiments referred to as "first tube"), in this embodiment comprising a first tube (12), and/or a receiver (10); and, an attachment device (3) for fixably attaching the weighted head and the tube, the attachment device (3) comprising a cap (19) and a second tube (6, 20); wherein: weighted head (1) optionally comprises: an inner (16) and an outer (17) surface enclosing an interior compartment (18) comprising a material (21) providing flexible weight to the weighted head (1); a first orifice (14) distal from the first tube (12); a second orifice (15) proximal to the first tube (12); attachment device (3) comprises a cap (19) and a connector (8) that may be received by a receiver (10) of the handle (2); the attachment device (3) contacts the outer surface of the weighted head by a cap (19); the cap (19) is fixably attached to the inner (16) and outer (17) surfaces of the weighted head (1); the attachment device (3) is fixably attached to the first tube (12); optionally first tube (12) and the second tube (6, 20) each comprise an orifice (7, 11) that align to one another upon attachment of attachment device (3) and handle (2); and, optionally further comprising a pin (13) protruding through each orifice (7, 11) to secure attachment device (3) and handle (2) to one another. In some embodiments, cap (19) may be fixably attached to the inner (16) and outer (17) surfaces by a bolt and nut combination (4, 9), a connector, and/or an adhesive. In some embodiments, material (21) may comprise sand, rubber and/or plastic. In some embodiments, weighted head (1) may comprise at least one orifice (14, 15) through which the first and/or second tubes (12, 6/20) enter and/or exit weighted head (1). In some embodiments, a first attachment device (3A) may be attached to weighted head (1) distal to the handle (2) and a second attachment device (3B) may be attached to weighted head (1) proximal to the handle (2) (e.g., as in FIG. 2). In some embodiments, the first tube (12) comprises one or more connectors (22) and weighted head (1) comprises one or more connectors (23) that interact with one another to secure weighted head (1) and handle (2) to one another (e.g., FIG. 3). In some embodiments, a system comprising multiple weighted heads (1) of different weights and a handle (2) such that the weighted heads (1) of different weights may be removably and interchangeably attached to handle (2).

Figure 3A:
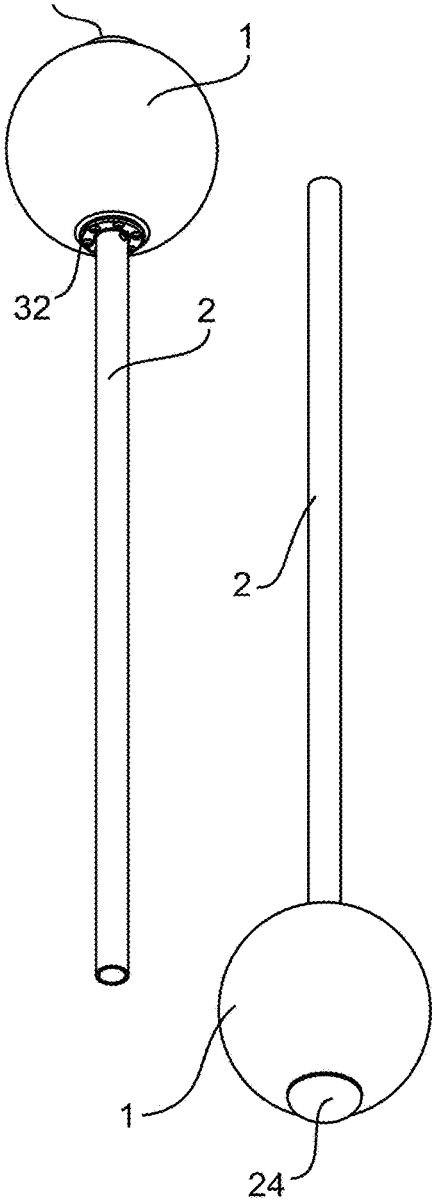
FIG. 3A. Side view of exemplary exercise device.
Figure 3B:
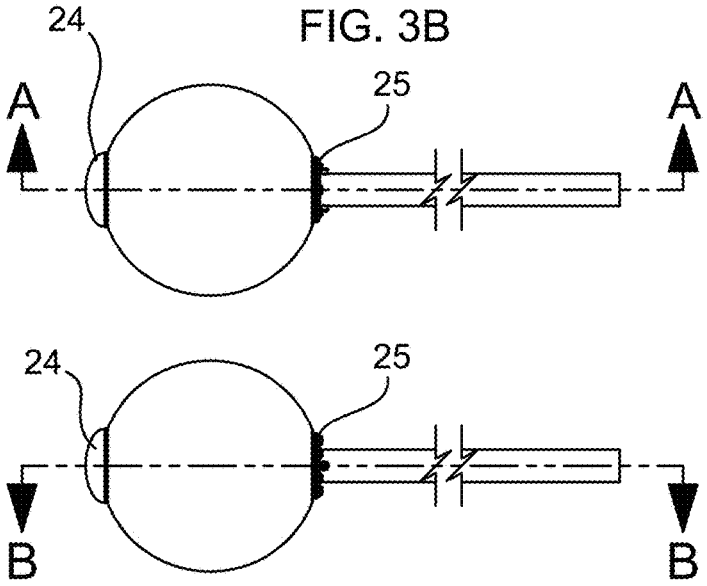
FIG. 3B. Additional side views of the exemplary exercise device.
Figure 3C:
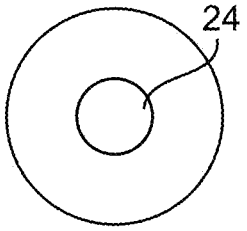
FIG. 3C. Top-down view of weighted head (1) and top cap apparatus (24).
Figure 3D:
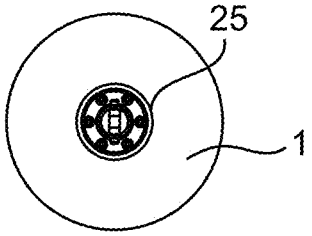
FIG. 3D. Bottom-up view of weighted head (1) and bottom connector apparatus (25).
Figure 3E:
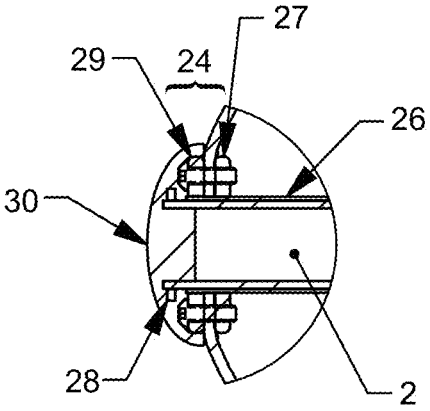
FIG. 3E. Detailed side view of top cap apparatus (24) arranged within and upon weighted head (1) (2: handle; 26: outer tube; 27: tapped plate is welded to outer tube; 28: retaining disc welded to end of handle; 29: through hole plate clamps ball to outer tube; 30: rubber).
Figure 3F:
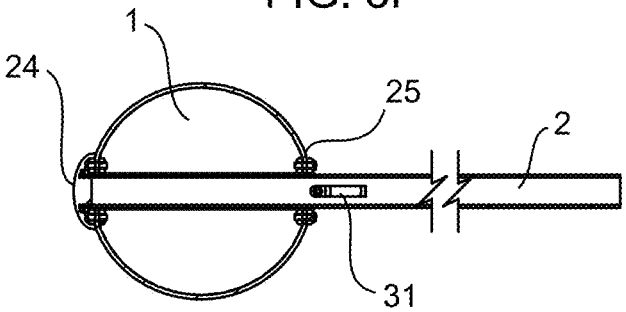
FIG. 3F. Side view of exercise device comprising top cap apparatus (24) and bottom connector apparatus (25) oriented opposite one another relative to weighted head (1), and quick-release connector (31) (exterior view).
Figure 3G:
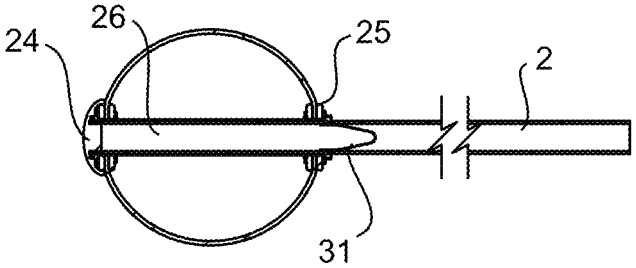
FIG. 3G. Side view of exercise device comprising top cap apparatus (24) and bottom connector apparatus (25) oriented opposite one another relative to weighted head (1), and quick-release connector (31) (interior view) (slam ball is filled to desired to weight with sand).
Figure 3H:
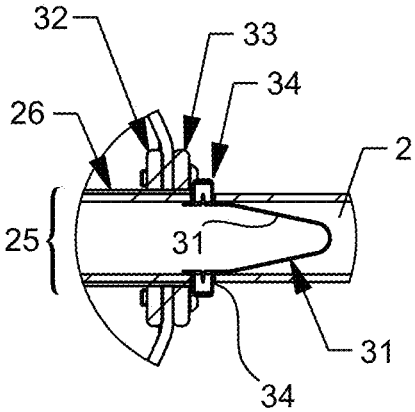
FIG. 3H. Side view of bottom connector apparatus (25) with quick-release connector (31 (quick-release connector locks slam ball in place)) positioned within handle (2) (interior view) (26: outer tube; 32: tapped plate is welded to outer tube; 33: through hole plate clamps ball to outer tube).

An illustrative embodiment is shown in FIGS. 3A-H. FIGS. 3A and 3B provide side views of a completely assembled device comprising a weighted head (1) and a handle (2). In these embodiments, the weighted head includes a top cap apparatus (24) and a bottom connector apparatus (25), each of which are fixably attached (e.g., connected) thereto, and/or a second tube (26) traversing through weighted head (1) (e.g., as does 6/20 in FIG. 1). Top cap apparatus (24) and bottom connector apparatus (25) are typically positioned opposite one another with respect to the circumference of weighted head (1). For instance, top cap apparatus (24) may considered to be positioned at the "top" of weighted head (1) and the bottom connector apparatus (25) may be considered to be positioned at the "bottom" of weighted head (1). In some embodiments, second tube (26) may extend beyond the outside edge of weighted head (1), e.g., it may protrude from the weighted head (1) and through the bottom connector apparatus (25). Second tube (26) typically has a diameter greater than that of handle (2), such that handle (2) may be positioned within second tube (26) (e.g., in manufacture handle (2) may be inserted into second tube (26)). FIG. 3C provide top-down view of top cap apparatus (24). FIG. 3D provides bottom-up view of bottom connector apparatus (25). As shown in FIG. 3E, in these embodiments, top cap apparatus (24) typically includes tapped plate (27) adjoined to (e.g., welded to) second tube (26) (referred to in FIG. 3E as "outer tube") through which handle (2) extends (i.e., in this embodiment, handle (2) is within second tube (26) ("outer tube")). In such embodiments, the diameter of handle (2) is less than that of second tube (26). Retaining disc (28) may be affixed to (e.g., welded to) and extend outwardly from the top end of handle (2) and, in some embodiments may encircle the, or extend around the circumference of, handle (2). Tapped plate (27) provides through holes (29) through which screws or similar devices may be inserted and used to clamp weighted head (1) to second tube (26) ("outer tube"). In some embodiments, tapped plate (27) may encircle the, or extend around the circumference of, second tube (26). Rubber cap (30) is typically affixed onto this assembly to complete top cap apparatus (24), further secure the same, and provide a smooth exterior thereto. FIG. 3F-H illustrate a side views of the device, showing quick-release connector (31) positioned within handle (2) and distal to top cap (24) (i.e., the "bottom" of weighted head (1) where top cap apparatus is considered to be at the "top" of the device). Quick-release connector (31) is used to connect (e.g., secure) weighted head (1) handle (2) to one another. Quick-release connector (31) is typically positioned within handle (2) and comprises buttons that are depressed and released to connect to holes within second tube (26), thereby connecting (e.g., securing) weighted head (1) to handle (2). A suitable quick-release connector is a device designed to use spring force and a pin-like button to hold telescoping pieces of tubing together (e.g., handle (2) and second tube (26)). The quick-release connector is typically inserted into the smaller (e.g., that with a smaller diameter) of the two tubes. The smaller diameter tube (e.g., handle (2)) is then inserted into the larger diameter tube (e.g., second tube (26)) until the connector button (which reversibly protrudes through a hole through the wall of the smaller diameter tube) pops into a hole of the larger diameter tube (e.g., second tube (26)) to reversibly secure the tubes to one another. Suitable quick-release connectors are widely available to those of ordinary skill in the art (e.g., the Zinc-Plated Steel Quick-Release Connector available from McMaster-Carr, such as part number #94282A370). As shown in FIG. 3H, the bottom connector apparatus (25) may include tapped plate (32) adjoined to second tube (26) (referred to in FIG. 3E as "outer tube") through which handle (2) extends (i.e., as for the top cap piece (24), in this embodiment, handle (2) is within second tube (26) ("outer tube")). Tapped plate (32) provides through holes (33) through which screws or similar devices may be inserted and used to clamp weighted head (1) to second tube (26) ("outer tube"). This section of the second tube (26) ("outer tube") also includes holes (34) positioned to receive the connector buttons of the quick-release connector (31). As described above, this arrangement provides for weighted head (1) to be reversibly connected to handle (2). In some embodiments, second tube (26) may have a diameter less than that of handle (2) (first tube), and second tube in positioned within handle (2). In some embodiments such as this, or others, the quick-release connector may be positioned within either the handle (2) or the second tube (26). The exercise device could also comprise a single tube providing the functions of both handle (2) and second tube (26). Other embodiments of this device may be designed by varying the parts described herein as would be understood by those of ordinary skill in the art.

Figure 4A:
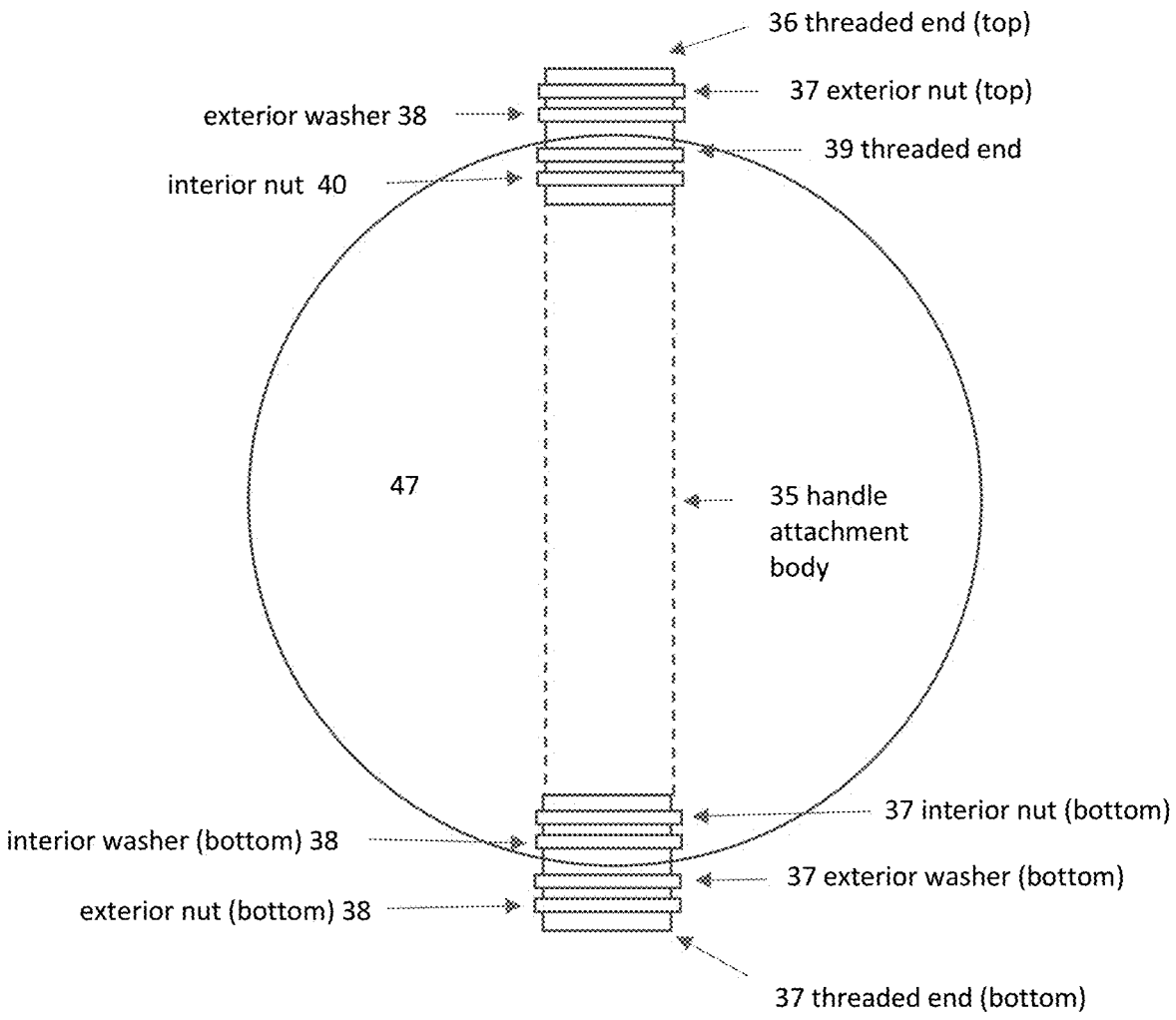
FIG. 4A. Exemplary exercise device comprising a washer/nut assembly attached to the ball at each end of a handle attachment assembly body.
Figure 4B:
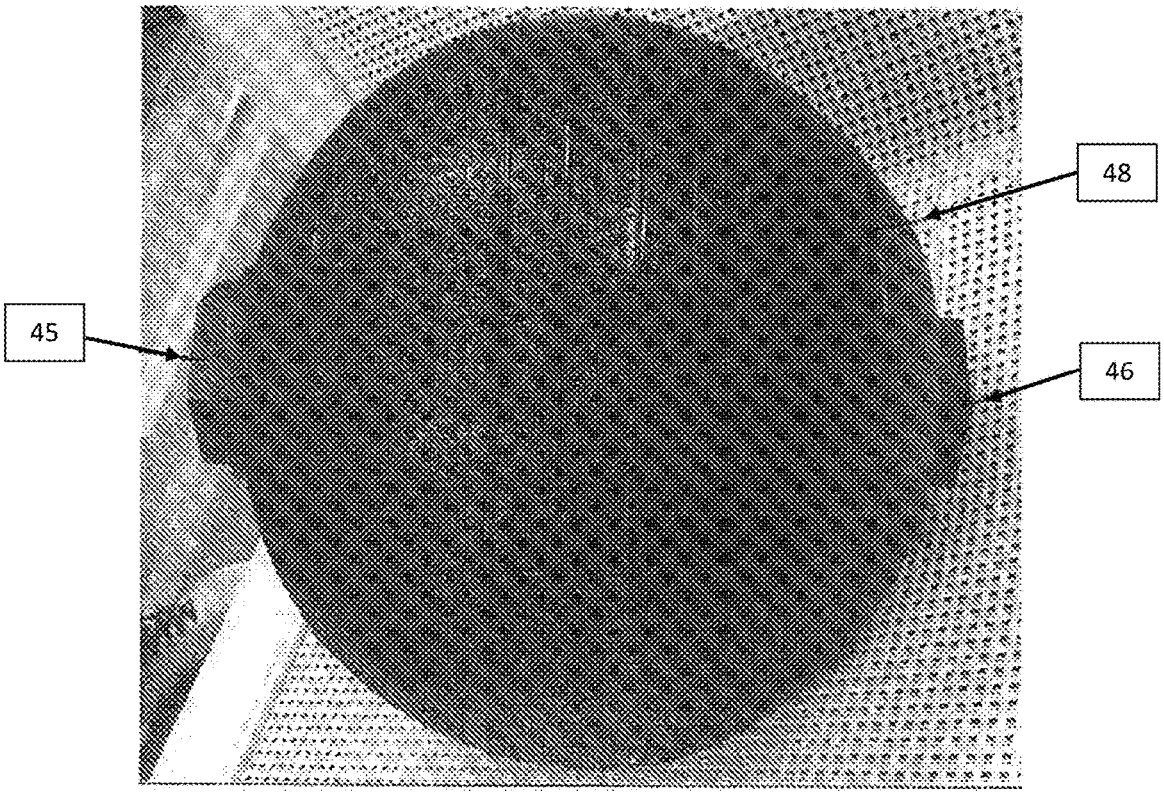
FIG. 4B. Side view of assembled weighted head.
Figure 4C:
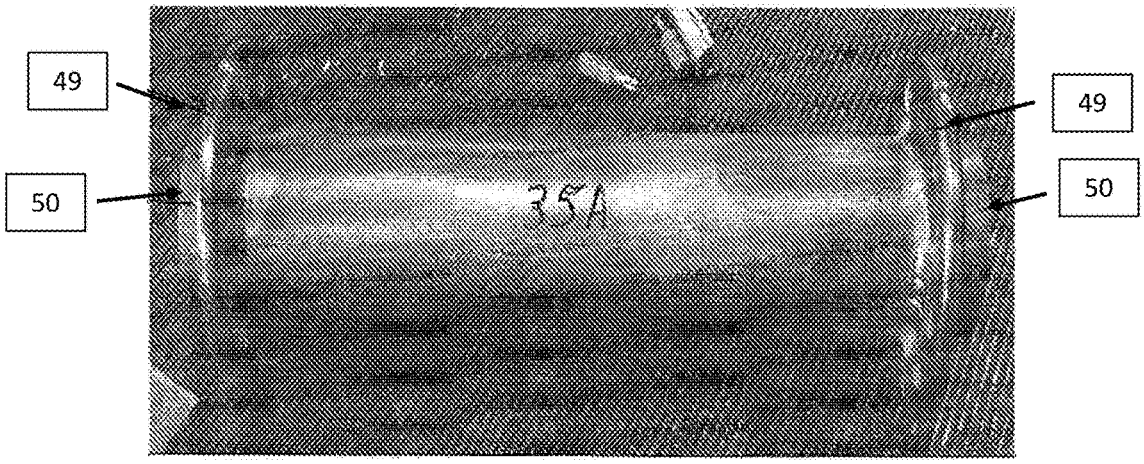
FIG. 4C. Exemplary handle assembly body.
Figure 4D:
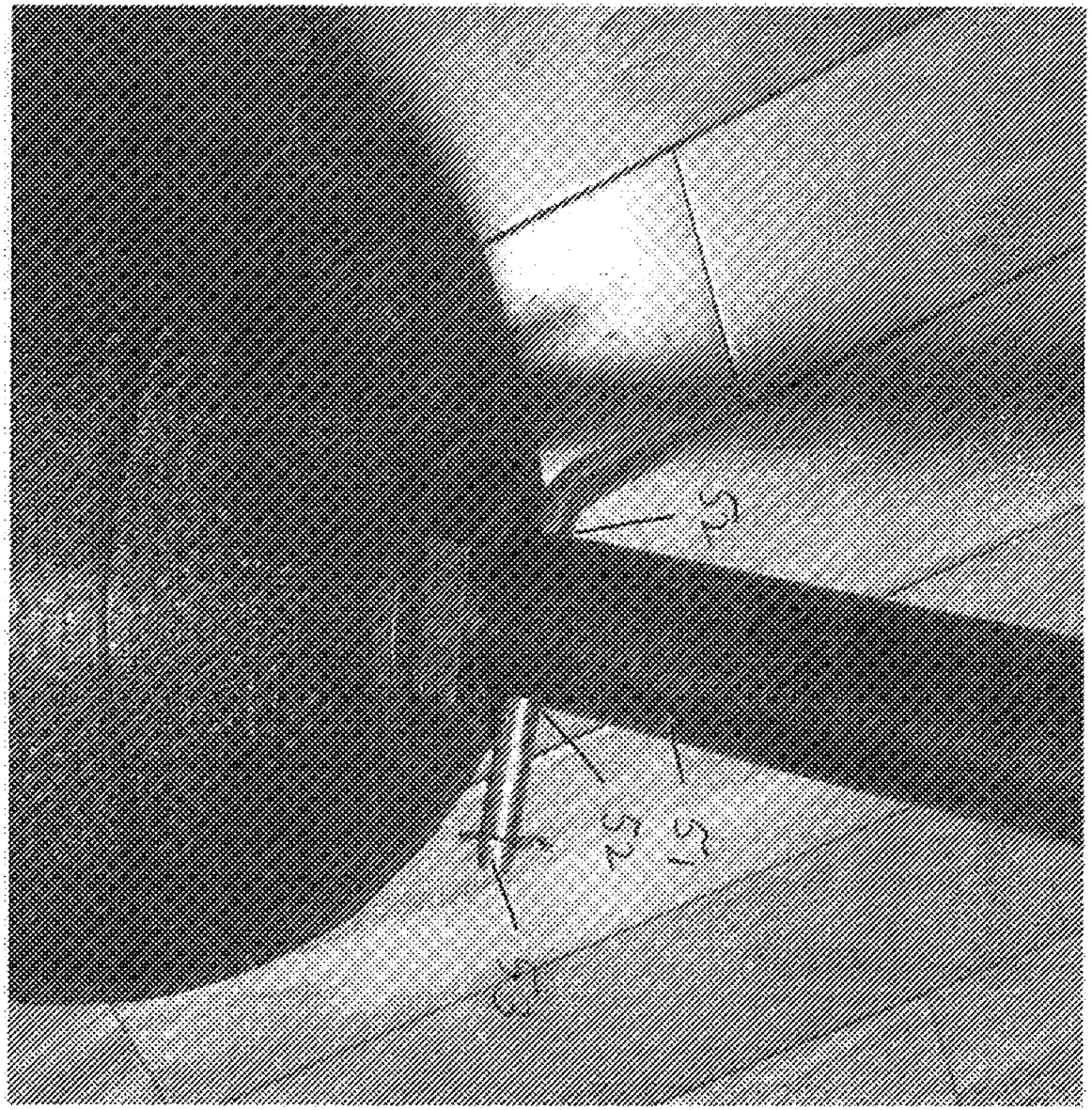
FIG. 4D. View of exemplary exercise device.
Figure 4E:
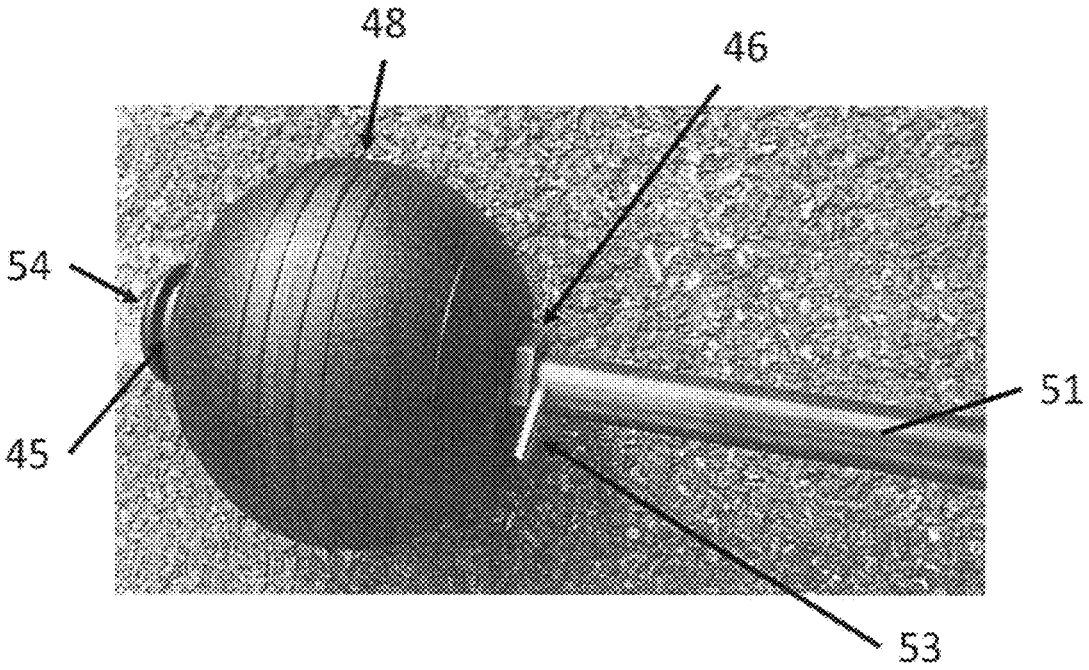
FIG. 4E. Additional view of exemplary exercise device.
Figure 4F:
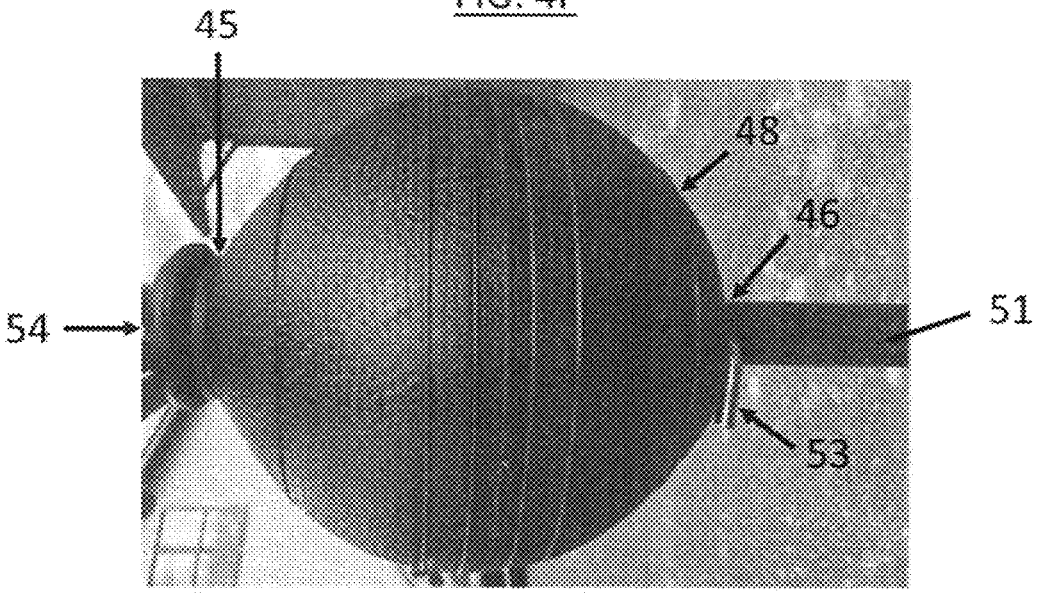
FIG. 4F. Additional view of exemplary exercise device.

Another illustrative embodiment is shown in FIG. 4. As illustrated in FIG. 4A, in one embodiment, the exercise device can include a handle attachment assembly body (35) extending through a weighted head (48, in some embodiments at least partially filled with fill material 47). Handle attachment assembly body (35) includes screw threads at each end (i.e., two opposite threaded ends). In the illustrated embodiment, the screw threads at each end extend from within the interior to the exterior of weighted head (48) (e.g., crossing the support material forming the surface of weighted head (48)). At each such end, a first set of one or more washers (preferably one) and one or more nuts (preferably one) are affixed to the interior screw threads and a second set of one or more washers (preferably one) and one or more nuts (preferably one) are affixed to the exterior screw threads, with the support material forming the surface of weighted head (48) positioned between the two sets. Tightening the nuts against the washers secures the same against the surface of that support material, therefore forming a seal (e.g., enclosing the fill material (47) within the interior of weighted head (48)). FIG. 4A illustrates two sets of these components at each end of handle attachment assembly body (35) as arrangements 45 and 46. FIG. 4B provides a view of an assembled weighted head including washer/nut arrangements 45 and 46 positioned at either end of weighted head (48). In some embodiments, the handle attachment assembly body (35A) can be prepared as a molded and/or welded piece comprising a support surface (e.g., a shelf or shoulder; internal welded flange (49)) providing the same function as that provided by the interior washer/nut assembly and can include screw threads (50) protruding beyond the main body thereof (see, e.g., FIG. 4C (but typically not including the holes shown therein). In such embodiments, the washer/nut arrangement positioned on the opposite surface (e.g., the exterior) of weighted head (48) can be tightened onto that support surface (e.g., 49), thereby providing a sealing function to maintain (i.e., seal) the fill (47) within weighted head (48), such that it does not substantially leak (or leak) from the interior of weighted head upon use. In some embodiments, a sealing and/or or adhesive material, such as but not limited to a sealant (e.g., a silicone rubber such as Dow Corning® RTV Sealant), may be applied between any of these components (e.g., the surface (e.g., the exterior) of weighted head (48) and any other component) in order to, e.g., further maintain fill (47) within weighted head (48). In some embodiments, such a sealant and/or adhesive is present between the exterior washer (e.g., 38 and 43 in FIG. 4A) and surface (e.g., the exterior) of weighted head (48). In such illustrative embodiments, a handle assembly (51) is typically positioned within the handle attachment assembly body (35), (e.g., traversing through the center of weighted head (48)) (e.g., a handle assembly comprised of a single tube and providing the functions of both handle (2) and second tube (26), as described above) and provide for reversible attachment to weighted head (48) thereto. As shown in FIG. 4D, the tube forming the handle typically includes corresponding holes (52) on each side through which an attachment device such as, but not limited to, a pin (53; e.g., a cotter pin, lock pin)

affixed thereto and securing weighted head (48) and handle (51) to another. The washer/nut assembly (45) at the top of weighted head (48) is typically covered by a cap 54 (e.g., a flexible cap such as a rubber cap) (although an inflexible cap may also be suitable) that can be affixed to the handle using an adhesive such as, but not limited to, an epoxy. Cap (54) may also be adjoined with other materials (e.g., additional washers and/or the like) providing additional support to that junction between the washer/nut assembly (45) and the handle assembly (51) (FIG. 4E). In some embodiments, this illustrative exercise device, and variations thereof, may be assembled by inserting the handle assembly (53) through weighted head (48) such that holes (52) protrude from weighted head (48) such that an attachment device (e.g., pin 53) may be reversibly affixed thereto through the holes to reversibly attach weighted head (48) and handle assembly (53) (e.g., FIG. 4F). This disclosure also provides methods of manufacturing this illustrative exercise device by, for instance, preparing weighted head comprising opposite holes and inserting handle attachment assembly body (35) into the same and tightening the one or more washer/nut assemblies (e.g. 45, 46) thereto, inserting handle assembly through handle attachment assembly body (35), and inserting attachment device (e.g., pin 53) through holes in handle attachment assembly body (35) to secure weighted head and handle attachment assembly body to one another. In some embodiments, interior and exterior nuts (37, 40, 41, 44) are not included, and instead interior and exterior washers (38, 39, 42, 43) are threaded washers, thereby providing a similar structural support to the device as the combination of nuts and washers. In some embodiments, the above-mentioned sealing and/or or adhesive material are positioned between the is positioned (e.g., applied) between the exterior washer (e.g., 38 and 43 in FIG. 4A) and surface (e.g., the exterior) of weighted head (48), although in some embodiments it could also be positioned (e.g., applied) between an interior washer and the interior surface of weighted head (48). Other embodiments of these illustrative devices and methods are also contemplated herein as will be understood by those of ordinary skill in the art.

In some embodiments, methods for manufacturing the exercise device described herein are provided. In some embodiments, the methods comprise attaching weighted head (1) (before or after material providing its weight is deposited into the interior thereof) is attached (e.g., connected) to handle (2). Weighted head (1) and handle (2) may take any form described herein (e.g., a weighted head (1) comprising a top cap piece (24) and a bottom connector apparatus (25), most preferably at least the bottom connector apparatus (25)), or any other that those of ordinary skill in the art may find to be suitable. In some embodiments, a top cap piece (24) and a bottom connector apparatus (25) are attached to a weighted head (1) (before or after the weighted head is actually weighted, i.e., at least partially filled with a material such as sand providing weight to weighted head (1)), adjoining (e.g., connecting) the second tube (26) and handle (2) to one another, with or without engaging a button in a quick-release connector (31) that may be present in the first tube (handle (2) or the second tube (26)). The button of the quick-release connector may be engaged by aligning holes in the second tube (26) and the handle (2) such that the button may traverse such holes, thereby reversibly securing the second tube (26) and the handle (2) to one another. Other methods for making an exercise device described herein are also contemplated, as would be understood by those of ordinary skill in the art.

In some embodiments, this disclosure provides an exercise device comprising a weighted head and a handle, and further comprising: a handle attachment assembly body extending through a weighted head comprising a support surface surrounding an interior region comprising fill material, wherein: the handle attachment assembly body comprises at least two ends and interior and exterior screw threads at least one end, and optionally at both ends, optionally wherein said screw threads extend from within the interior to the exterior of weighted head; or, the handle attachment assembly body comprises at least one support surface, optionally an internal welded flange, and interior and exterior screw threads extend from within the interior to the exterior of weighted head; said interior screw threads being positioned within the interior of weighted head; said exterior screw threads being positioned exterior to the weighted head; at least a first set of one or more washers and one or more nuts affixed to the exterior screw threads and adjacent to the exterior surface of the weighted head; wherein: the at least a first set of one or more washers and one or more nuts, in combination with either a second set of one or more washers and one or more nuts affixed to the interior screw threads of the handle attachment assembly body, apply pressure upon the support surface of the weighted head, thereby sealing the same and preventing the release of fill material therefrom; or, the at least a first set of one or more washers and one or more nuts, in combination with the at least one support surface of the handle attachment assembly body, apply pressure upon the support surface of the weighted head, thereby sealing the same and preventing the release of fill material therefrom; and, optionally, a sealant is applied between the washer(s), nut(s), support surface, and weighted head surface; the exercise device further comprising: a handle assembly positioned within the handle attachment assembly body, said handle assembly comprising a top and bottom end, a cap at said top end, and at least two corresponding holes positioned toward said bottom end; and an attachment device inserted into said two corresponding holes whereby the weighted head and the handle assembly are reversible affixed to one another. In some embodiments, methods for making such exercise devices are provided, said methods comprising: inserting said handle attachment assembly body through the interior of the weighted head; tightening the one or more washer/nut assemblies thereto; inserting a handle assembly through handle attachment assembly body; and, inserting an attachment device through holes in handle attachment assembly body to secure weighted head and handle attachment assembly body to one another.

In some embodiments, this disclosure provides an exercise device comprising a weighted head and a handle, and further comprising: a handle attachment assembly body extending through a weighted head comprising a support surface (e.g., 48) surrounding an interior surface surrounding an interior region comprising fill material (e.g., 47), the support surface also comprising an exterior surface wherein: the handle attachment assembly body (35) comprises at least two ends and interior and exterior screw threads at least one end, and optionally at both ends (e.g., 36, 37), optionally wherein said screw threads extend from within the interior to the exterior of weighted head (FIG. 4A); and/or, the handle attachment assembly body comprises at least one support surface, optionally an internal welded flange and/or one or more internal washer(s) optionally being one or more interior threaded washer(s); and interior and exterior screw threads extending from within the interior to the exterior of weighted head, interior and exterior screw threads being demarcated by the support surface of the weighted head, such that said interior screw threads are positioned within the interior of weighted head and said exterior screw threads are positioned exterior to the weighted head; at least a first washer (optionally threaded washer) and/or set of such washers and/or one or more nuts affixed to the exterior screw threads and adjacent to the exterior surface of the weighted head; wherein: the at least a first set of one or more interior and exterior washers, optionally threaded washers, and/or one or more nuts, in combination with either a second set of one or more corresponding interior or exterior washers, optionally threaded washers, as the case may be, and/or one or more nuts affixed to the interior screw threads of the handle attachment assembly body, apply pressure upon the support surface of the weighted head, thereby sealing the same and preventing the release of fill material therefrom (optionally wherein a sealant or adhesive is present between the surfaces of the one or more interior and/or exterior washers and the interior surface or exterior surface, respectively, of the supported surface of the weighted head); and/or, the at least a first set of one or more washers and one or more nuts, in combination with the at least one support surface of the handle attachment assembly body, apply pressure upon the support surface of the weighted head, thereby sealing the same and preventing the release of fill material therefrom; and, optionally, further comprising at least one sealant and/or adhesive between the washer(s), optionally threaded washer(s), or internal welded flange, and the interior surface and/or exterior surface of the support surface of the weighted head. In some embodiments, the exercise device may further comprise a handle assembly positioned within the handle attachment assembly body, said handle assembly comprising a top and bottom end, a cap at said top end, and at least two corresponding holes positioned toward said bottom end; and/or, and an attachment device inserted into said two corresponding holes whereby the weighted head and the handle assembly for reversibly affixing the weighted head and the handle assembly to one another. In some embodiments, this disclosure also provides methods for making such as exercise device by, for example, inserting said handle attachment assembly body through the interior of the weighted head; tightening the one or more washer (and/or nut) assemblies thereto; inserting the handle assembly through handle attachment assembly body; and/or, inserting an attachment device through holes in handle attachment assembly body to secure weighted head and handle attachment assembly body to one another. In some embodiments, this disclosure provides methods for manufacturing such an exercise device of any by attaching weighted head, before or after material providing its weight is deposited into the interior thereof, to the handle. In some embodiments, this disclosure provides methods for using such as exercise device, wherein a user raises the device above a solid surface (e.g., a floor) and then drops the weighted head to that surface while holding onto the handle, optionally repeated as desired by the user.

This disclosure also provides, as separate, individual components, the handle attachment assembly body described above, and/or the handle assembly described herein. Other embodiments are also contemplated, as would be understood by those of ordinary skill in the art.

In some embodiments, methods for using the exercise devices described herein are provided. In some embodiments, a user raises the device above a solid surface (e.g., a floor) and then drops the weighted head to that surface while holding onto the handle, a movement that is repeated as desired by the user. Weighted heads of differing weights may be attached to a handle, providing users of different strengths with an exercise regimen customized to their strength. For instance, one user may selected a weighted head of, for instance, 10 lbs while another may selected a weighted head of, for instance, 30 pounds. A user may also perform a certain number of repetitions using a weighted head of one weight (e.g., 10 lbs) and a certain number of repetitions using a weighted head of another weight (e.g., 30 lbs), using the same handle, by changing the weighted head attached thereto (e.g., using the quick-release connector). Other methods for using an exercise device described herein are also contemplated, as would be understood by those of ordinary skill in the art.

The terms "about", "approximately", and the like, when preceding a list of numerical values or range, refer to each individual value in the list or range independently as if each individual value in the list or range was immediately preceded by that term. The terms mean that the values to which the same refer are exactly, close to, or similar thereto. Optional or optionally means that the subsequently described event or circumstance can or cannot occur, and that the description includes instances where the event or circumstance occurs and instances where it does not. Ranges may be expressed herein as from about one particular value, and/or to about another particular value. When such a range is expressed, another aspect includes from the one particular value and/or to the other particular value. Similarly, when values are expressed as approximations, by use of the antecedent about or approximately, it will be understood that the particular value forms another aspect. It will be further understood that the endpoints of each of the ranges are significant both in relation to the other endpoint, and independently of the other endpoint. Ranges (e.g., 90-100%) are meant to include the range per se as well as each independent value within the range as if each value was individually listed. The term "combined" or "in combination" or "in conjunction" may refer to a physical combination of components and/or parts, either physically or functionally.

All references cited within this disclosure are hereby incorporated by reference in their entirety. Certain embodiments are further described in the following examples. These embodiments are provided as examples only and are not intended to limit the scope of the claims in any way. While certain embodiments have been described in terms of the preferred embodiments, it is understood that variations and modifications will occur to those skilled in the art. Therefore, it is intended that the appended claims cover all such equivalent variations that come within the scope of the following claims.

What is claimed is:

1. An exercise device comprising a weighted head and a handle, the exercise device comprising:

the handle;

a handle attachment assembly body extending through the weighted head, the weighted head comprising a support surface surrounding an interior surface surrounding an interior region comprising fill material, the support surface also comprising an exterior surface wherein:

the handle attachment assembly body comprises top and bottom ends and interior and exterior screw threads at each of the top and bottom ends each, wherein said interior and exterior screw threads extend from within the interior to the exterior surface of weighted head;

a first set of one or more washers and/or one or more nuts affixed to the interior and exterior screw threads extending from the exterior surface of the weighted head;

a second set of one or more washers and/or one or more nuts affixed to the interior screw threads of the handle attachment assembly body;

optionally, further comprising at least one sealant and/or adhesive between at least one washer of the first and second set of one or more washers and/or one or more nuts, and the interior surface and/or exterior surface of the support surface;

wherein:

the handle is partially positioned within the handle attachment assembly body and comprises;

at least two holes and a pin configured to engage the at least two holes;

through which the weighted head and the handle assembly are reversibly affixed to one another.

2. A method for using the exercise device of claim 1, wherein a user raises the exercise device above a solid surface and then drops the weighted head to the solid surface while holding onto the handle, optionally repeated as desired by the user.

* * * * *